United States Patent [19]

Shortridge

[11] Patent Number: 4,553,779

[45] Date of Patent: Nov. 19, 1985

[54] SKI CADDY

[76] Inventor: Timothy D. Shortridge, 4460 50th St., San Diego, Calif. 92115

[21] Appl. No.: 615,355

[22] Filed: May 30, 1984

[51] Int. Cl.[4] ..... A63C 11/02

[52] U.S. Cl. ..... 294/147; 294/152; 294/162

[58] Field of Search ..... 294/138, 143, 146, 147, 294/149, 152, 156, 157, 159, 161–163, 165; 211/60 SK; 224/917; 280/814, 815

[56] References Cited

U.S. PATENT DOCUMENTS

| | | | |
|---|---|---|---|
| 3,268,134 | 8/1966 | Baston et al. | 294/152 |
| 3,278,097 | 10/1966 | Duckworth | 294/147 X |
| 3,486,672 | 12/1969 | Esopi | 294/147 X |
| 3,947,927 | 4/1976 | Rosenthal | 294/147 X |
| 3,994,048 | 11/1976 | Rosenthal | 294/147 X |
| 4,055,287 | 10/1977 | Champenois | 294/152 X |
| 4,114,838 | 9/1978 | Knauf | 294/157 |
| 4,120,437 | 10/1978 | Hara | 280/814 |
| 4,377,306 | 3/1983 | Abatecola | 294/147 |

*Primary Examiner*—Johnny D. Cherry
*Attorney, Agent, or Firm*—Charmasson & Holz

[57] ABSTRACT

A foldable clutch or caddy for carrying elongated objects such as skis, ski poles and the like which can be readily folded and tucked away in a pocket when not in use comprises a main body of pliable fabric or other material which wraps around a first set of objects such as skis, and an auxiliary flap of material for wrapping around a second set of objects such as ski poles. One or more looped ribbons stitched to the main body form carrying handles. Various patches of hook and loop fastener material attached at strategic locations on the main body and flap combine to provide various forms of closure in both carrying and folded mode of the clutch.

7 Claims, 8 Drawing Figures

FIG. 1
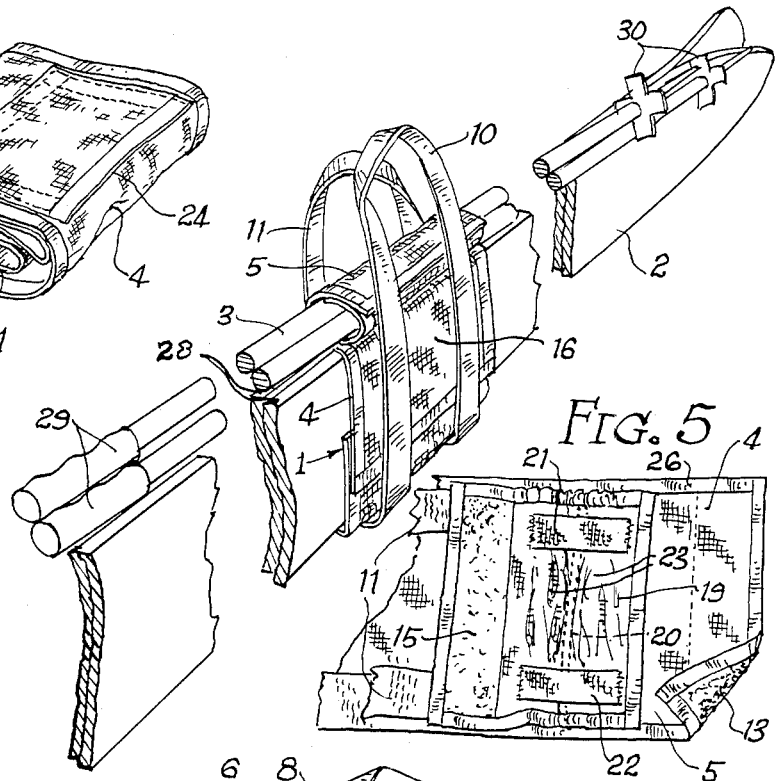
FIG. 2
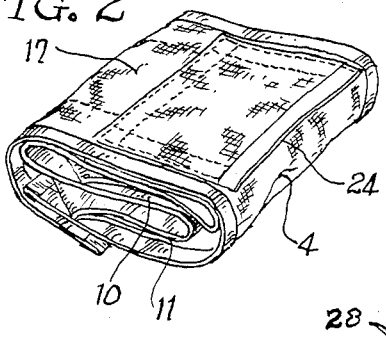
FIG. 5
FIG. 3
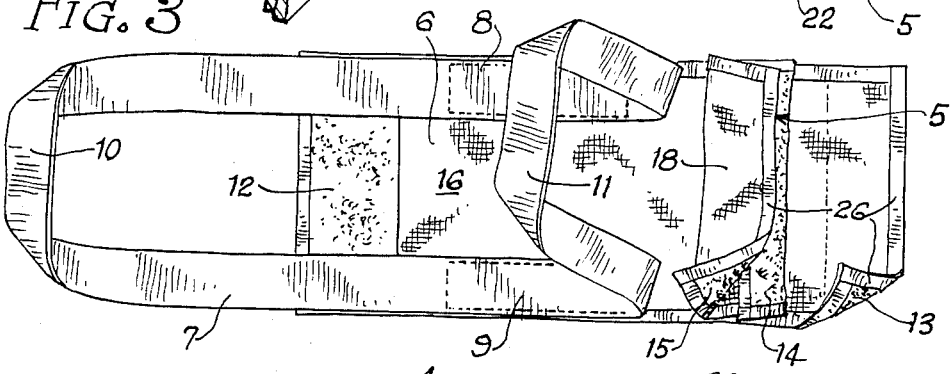
FIG. 4
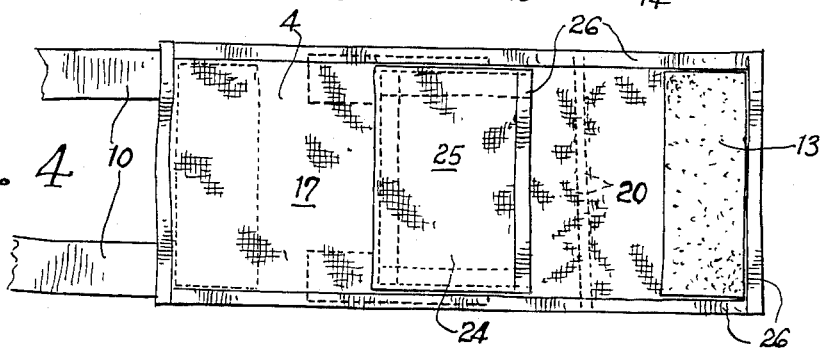

SKI CADDY

BACKGROUND OF THE INVENTION

The present invention relates to a foldable clutch or caddy for carrying elongated objects such as skis, ski poles and the like.

Elongated objects such as skis and ski poles are very awkward to carry by hand. Persons transporting skis and poles to and from cars and ski lifts by hand normally attempt to balance the skis and poles over their shoulder and support them in one hand, since they are too heavy and bulky to be grasped easily for carrying directly in one hand.

SUMMARY OF THE INVENTION

It is an object of the present invention to provide a device for aiding in carrying elongated objects such as skis and ski poles by hand.

According to the present invention a foldable clutch for carrying elongated objects such as skis and ski poles is provided, which comprises a main body of pliable material for wrapping around a first set of elongated objects such as skis, and an auxiliary flap for wrapping around a second set of objects such as ski poles. One or more carrying handles are attached to the main body. Preferably, one or more looped ribbons are stitched to the main body to form carrying handles.

Various releasable fasteners such as patches of hook and loop fastener material are attached at strategic locations on the main body and the flap to provide various forms of closure in both the carrying and the folded mode of the clutch. The fasteners allow the clutch to be readily folded and tucked away in a pocket when not in use.

The clutch allows elongate objects such as skis and ski poles to be carried readily and easily by hand.

BRIEF DESCRIPTION OF THE DRAWINGS

FIG. 1 shows the foldable clutch according to a preferred embodiment of the invention wrapped around a pair of skis and ski poles so that they can be carried by hand;

FIG. 2 shows the clutch of FIG. 1 folded flat for storage when not in use;

FIG. 3 shows the outer face of the clutch in its opened out, unwrapped position;

FIG. 4 shows the inner face of the clutch in its opened out, unwrapped position;

FIG. 5 shows an auxiliary flap of the clutch for wrapping around ski poles;

DESCRIPTION OF THE PREFERRED EMBODIMENT

Figure 6:
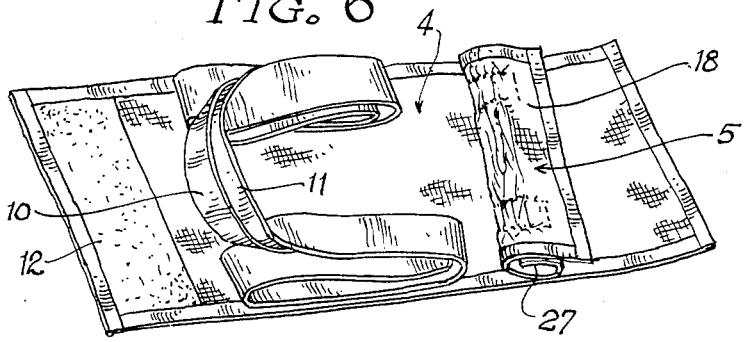
FIG. 6 is a view similar to FIG. 3 showing a first step in folding up the clutch to be stored flat as in FIG. 2.

The drawings show a preferred embodiment of a foldable clutch or caddy according to a preferred embodiment of the invention for carrying elongated objects such as skis and ski poles. The clutch 1 shown in the drawings is particularly suitable for carrying skis 2 and ski poles 3, as shown in FIG. 1.

As shown in FIGS. 3 to 5, the clutch basically comprises a main body 4 of a suitable pliable material in the form of a flat band or strip. As seen in FIG. 3, an auxiliary flap 5 of the same material is secured to the outer face of the main body 4, for example by stitching. A looped strip or ribbon 7 of suitable strength material is secured at opposed portions 8, 9 of the loop to opposite edge portions of the outer face 6 of the main body 4 to form carrying handles 10, 11, as seen in FIG. 3. The ribbon 7 is suitably secured to the body 4 by stitching. The carrying handles 10 and 11 are of different lengths, the longer handle 10 being long enough to pass under the clutch when it is in the carrying mode shown in FIG. 1 and project up upwardly in registry with the shorter handle 11.

Releasable fasteners such as patches or portions 12, 13, 14 and 15 of hook and loop fastener material, suitably Velcro (Registered Trade Mark), are attached at strategic locations to the main body 4 and auxiliary flap 5 to provide the various forms of closure in the carrying mode of the clutch shown in FIG. 1 and the folded mode of the clutch shown in FIG. 2. Patches 12 and 13 are provided on the outer and inner faces 16, 17 respectively, of the main body 4, as seen in FIGS. 3 and 4. Patches 14 and 15 are provided on the outer and inner faces 18 and 19, respectively, of the auxiliary flap 5, as seen in FIGS. 3 and 5.

The flap 5 is suitably secured to the main body 4 by a line 20 of stitching intermediate its ends to leave the end portions of the flap free to be wrapped around ski poles, for example.

Strips 21, 22 of elastic material may be secured to the inner face 19 of the flap 5, as shown in FIG. 5. The elasticated strips provide gathers or puckers 23 in the flap and aid in gripping ski poles.

Alternatively the entire flap 5 may be made from a resiliently stretchable fabric, to be wrapped tightly around the ski poles 3.

As shown in FIG. 4, a patch 24 of material is stitched along three edges to the inner face 17 of the main body 4 to form a pocket 25 which may be used for carrying valuables such as keys, cards, money, and the like.

Edging strips 26 may be stitched along all the side edges of the main body 4 and the auxiliary flap 5, and along the open edge of the pocket 25. The material of the clutch 1 may be any suitable pliable material or fabric such as nylon, laminated fabric, and other materials. The handles 10, 11 are of a pliable material of strength sufficient to take the weight of the articles to be carried, such as skis and ski poles.

When a pair of skis and ski poles are to be carried, the skis 2 are placed with their undersfaces together and the main body 4 of the clutch is wrapped around the skis so that the Velcro patches 12 and 13 overlap and can be secured together as shown in FIG. 1. The auxiliary flap 5 is wrapped around the poles 3 and the Velcro (Registered Trade Mark) patches 14 and 15 are pressed together to secure the poles in place as shown in FIG. 1. The longer carrying handle 10, can be passed under the entire assembly as shown to project upwardly so that the two handles can be held to carry the clutch, skis and ski poles.

It should be noted that the flap 5 is stitched to the main body 4 about a line 20 which is not exactly perpendicular to the longitudinal edges of the main body 4. This will cause the poles 3 to rest diagonally against the top edges 28 of the skis during transport as shown in FIG. 1, with the handles 29 and tip baskets 30 clearing the extremities of the skis.

Figure 7:
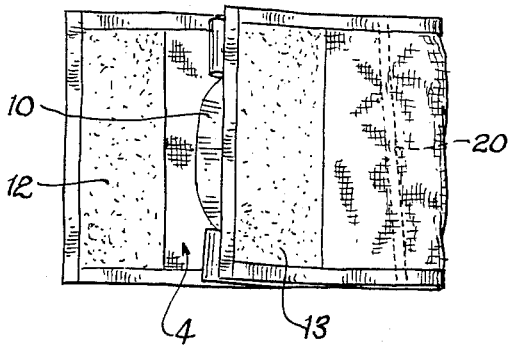
FIG. 7 shows a second step in folding the clutch flat for storage.
Figure 8:
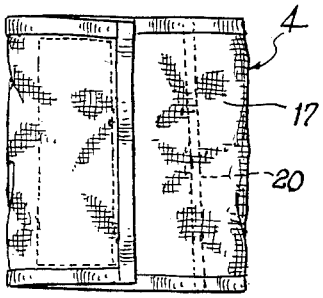
FIG. 8 shows the final step in folding the clutch flat as shown in FIG. 2.

When the clutch is not in use, for example during ski-ing or storage, it can be folded flat as shown in FIG. 2, and readily tucked away in a pocket, for example. This is done by first unwrapping the main body and placing it flat as shown in FIG. 6, with the auxiliary flap 5 wrapped over into a roll 27 and the straps 10, 11 folded substantially flat. A first end of the body 4 is then folded over the straps 10, 11 as shown in FIG. 7, with the patch 13 of Velcro material facing outwardly. The other end is then folded over the first end and the patches 12 and 13 of Velcro (Registered Trade Mark) are pressed together to form a substantially flattened assembly as shown in FIGS. 2 and 8. Thus the clutch can be placed in a pocket of ski clothing for carrying while skiing, and can be stored flat while not in use. The main body 4 is folded in opposite directions for carrying skis as shown in FIG. 1 and for storage as shown in FIG. 2. The outer face 16 faces outwards when the clutch is used for carrying skis, and the inner face 17 faces outwards when the clutch is folded flat for storage.

The clutch may additionally be used as a wallet or purse for carrying essentials such as keys, identity cards and/or money while skiing. The pocket 25 is provided for this purpose. The pocket is enclosed within the main body 4 while skis are being carried, but will be exposed as shown in FIG. 2 when the clutch is folded flat.

The main body and auxiliary flap and their associated fasteners thus provide various forms of closure in both the carrying mode and the folded mode. The choice of materials and relative proportions of the main body and auxiliary flap are determined by the weight and lengths of the objects to be carried. Thus in the preferred embodiment shown the auxiliary flap is smaller than the main body since ski poles are much shorter and lighter than skis. The carrying handles must be strong enough to support the weight of the elongated objects, for example skis and poles as shown.

The foldable clutch is lightweight, easy to use and very convenient for carrying awkward elongated objects such as skis and ski poles, and is flexible enough to double as a wallet for carrying valuables as necessary. The clutch can be readily tucked away in a pocket when not in use.

While the preferred embodiment of the invention has been described above, it will be understood that modifications may be made to the disclosed embodiment without departing from the scope of the invention, which is defined by the appended claims.

What is claimed is:

1. A foldable clutch for carrying a first set of elongated objects, such as skis, and a second set of elongated objects, such as ski poles, comprising:

a main rectangular body of pliable material, having an inner face and an outer face, for wrapping around said first set of elongated objects;

first fastener means for releasably securing said outer face at one end of said main body to the inner face at the opposite end thereof when said main body is in a wrapped conformation around said first set of elongated objects;

said first fastener means comprising interengageable strips of hook and loop fastening material secured along the inner and outer edges respectively of the shorter sides of said rectangular body, and said strips being located and dimensioned to releasably mate when the inner edge overlaps the outer edge and when the outer edge overlaps the inner edge;

an auxiliary flap of pliabie material, also having an inner face and an outer face, for wrapping around said second set of elongated objects;

the outer face of said auxiliary flap being permanently secured to the outer face of said main body and off the median area of said outer face;

said second set of elongated objects being positioned above said first set of elongated objects;

second fastener means for releasably securing one side of said auxiliary flap to the opposite side thereof when said auxiliary flap is in a wrapped conformation around said second set of elongated objects; and a pair of handles comprising an elongated continuous loop of ribbon having two parallel spaced-apart, linear portions running along the longer sides on the outer face of said rectangular body and being permanently attached to the median area of said outer face.

2. The clutch as claimed in claim 1, wherein said auxiliary flap is secured to an intermediate position in its length to said main body.

3. The clutch as claimed in claim 2, wherein said auxiliary flap is at least partially elasticized for gripping said second set of elongated objects.

4. The clutch as claimed in claim 3, wherein two strips of elastic material are sewn to said inner face of said auxiliary flap.

5. The clutch as claimed in claim 1, wherein the inner face of said main body includes a pocket.

6. The clutch as claimed in claim 1, wherein said main body may be folded and releaseably secured with said first fastener means in a substantially flat conformation for stowage when said clutch is not being utilized to carry said first and second pair of elongated objects, with the inner face exposed, such that said auxiliary flap and said pair of handles are enclosed within said main body.

7. The clutch as claimed in claim 1 wherein said auxiliary flap is attached to said main body along a line which is non-parallel to said shorter sides.

* * * * *